US010674875B1

(12) United States Patent
Spaulding

(10) Patent No.: US 10,674,875 B1
(45) Date of Patent: Jun. 9, 2020

(54) COVER ASSEMBLY ATTACHABLE TO A BATHTUB

(71) Applicant: Benjamin Spaulding, Key Largo, FL (US)

(72) Inventor: Benjamin Spaulding, Key Largo, FL (US)

( * ) Notice: Subject to any disclaimer, the term of this patent is extended or adjusted under 35 U.S.C. 154(b) by 0 days.

(21) Appl. No.: 16/199,996

(22) Filed: Nov. 26, 2018

Related U.S. Application Data

(63) Continuation-in-part of application No. 15/666,638, filed on Aug. 2, 2017, now abandoned.

(51) Int. Cl.
*A47K 3/30* (2006.01)

(52) U.S. Cl.
CPC ..... *A47K 3/302* (2013.01)

(58) Field of Classification Search
CPC ..... A47K 3/302
USPC ..... 4/580, 559, 658, 609
See application file for complete search history.

(56) References Cited

U.S. PATENT DOCUMENTS

| | | | | |
|---|---|---|---|---|
| D106,335 | S | 5/1937 | Tschappat | |
| 2,152,968 | A | 5/1938 | Monge | |
| 2,131,111 | A * | 9/1938 | Marsh | A47J 47/20 4/658 |
| 4,025,970 | A | 5/1977 | Robust | |
| 5,365,619 | A | 11/1994 | Solomon | |
| D388,867 | S | 1/1998 | Baca | |
| 6,341,388 | B1 | 1/2002 | Roberts | |
| 6,453,485 | B2 | 9/2002 | Bullock | |
| 2011/0258768 | A1 | 10/2011 | Spingola et al. | |

FOREIGN PATENT DOCUMENTS

| | | |
|---|---|---|
| WO | WO9416608 A1 | 8/1994 |

* cited by examiner

*Primary Examiner* — Tuan N Nguyen
(74) *Attorney, Agent, or Firm* — Malloy and Malloy, PL; Jennie Sue Malloy

(57) ABSTRACT

The present invention relates to a cover assembly that is attachable to a bathtub to reduce water spilling to areas outside the bathtub. In one embodiment, the cover assembly comprises a protective section and a flexible extended segment. The protective section comprises at least a front structure configured to help provide protection to an individual from physical impacts against the bathtub. The flexible extended segment is disposed adjacent the protective section and comprises a first surface and a second surface. The flexible extended segment is disposable into and out of an expanded orientation and a constricted orientation. The protective section and the flexible extended segment are collectively disposable into and out of an operative orientation and an inoperative orientation. The operative orientation comprises the flexible extended segment being disposed in the constricted orientation and attached to at least a portion of an inner surface of the bathtub.

20 Claims, 6 Drawing Sheets

COVER ASSEMBLY ATTACHABLE TO A BATHTUB

CLAIM OF PRIORITY

The present application is a Continuation-in-Part to a currently pending Non-Provisional patent application having Ser. No. 15/666,638 and a filing date of Aug. 2, 2017, the contents of which are incorporated herein by reference it its entirety.

BACKGROUND OF THE INVENTION

Field of the Invention

The present invention relates to a cover assembly attachable to a bathtub and structured to help avoid, reduce or limit water, soapy liquid or other liquids spilling over and outside of the bathtub and further, to help protect an individual from a direct physical impact against the bathtub.

Description of the Related Art

Wet environments are well known to exist generally in bathrooms, but especially when there is a bathtub that is frequently used, particularly if used by a child. The spilling of water outside of a bathtub usually results in a wet floor that can be hazardous and present risk for a person to slip and fall, suffer physical injury and potentially to create other problems. For example, water from a bathtub may soak an adjacent area, such as a bathroom floor, water closet, or hallway, etc. and possibly other areas. Bathrooms floors may also have small rugs and/or other materials susceptible to moisture, such as carpet or a synthetic flooring product. Therefore, liquid spilling over from a bathtub in an already wet bathroom environment may contribute to the deterioration of the bathroom floor. Additionally, slippery surfaces are oftentimes associated with such wet environments and pose an increased risk for a person to slip and fall on them which that may lead to a serious physical injury. This may affect individuals of all ages but among the elderly, falls are a serious issue and can at times be fatal. Lacerations, fractures, including hip fractures, and head trauma are a common result of falls.

However, even when a baby, toddler or small child is taking a bath, it is somewhat common for the child to play and splash in the bathtub, including standing up or moving about within the bathtub, into and out of the bathtub, etc. and even with parental supervision, falls can happen that result in physical injury. Additionally, a parent or caretaker may lose his or her grip on the child, adding to the risk of a physical injury to the child. As a result, a child may fall or stumble and hit his/her face, head, back, or other body part on the bathtub, which could result in chipped or broken teeth, lacerations, broken noses, and fractures, including serious ones, such as fractures of the jaw or the skull. Accordingly, there is a need to reduce the effort required of a caretaker during bathing sessions, including the effort associated with ensuring the child's safety.

There are other reasons why it would be helpful to avoid spillage of water, soapy water or other liquids from a bathtub. For example, it would be helpful to reduce the clean-up burden associated with use of a bathtub, as well as to improve the safety of children during bathing sessions. In today's society there are lesser stay-at-home parents compared to previous times, being attributable in part, to the increased number of mothers joining the workforce. Further, many mothers re-enter the workforce soon after giving birth to a child. Thus, the time that a caretaker, such as a parent, can devote to a child, comes at a premium compared to previous times. Households would greatly benefit from a reduced amount of effort to clean-up a bathroom floor, including wet bathroom floors.

As such, there is a need in the art for a device that helps to limit, reduce or avoid water or other liquids spilling from a bathtub, so as to alleviate the burden associated with subsequent clean-up of the bathroom floor and other areas. Ideally, any such device would also help to avoid at least some physical injuries associated with falls in a bathtub and bathroom environment.

SUMMARY OF THE INVENTION

The present invention is intended to present a solution to such needs and is directed towards a cover assembly that is structured and disposed for attachment to a bathtub, and to reduce or avoid liquid spilling from inside a bathtub to outside areas. It is also within the scope of the present invention that the cover assembly at least partially lower the risk of physical injury to an individual when inside of the bathtub.

The cover assembly of the present invention comprises in one or more embodiments an elongated component structured for attachment to a bathtub, and ideally to at least a portion of the bathtub's inner perimeter wall, such as at or near an upper zone thereof. However, the length of the cover assembly may vary according to a desired length or section of the bathtub perimeter desired for attachment to and providing protection.

The cover assembly of the present invention generally comprises a protective section and a flexible extended segment. The flexible extended segment provides support to the protective section, and is generally attached to the bathtub. The flexible extended segment comprises a first surface that generally faces towards the inside of the bathtub. The flexible extended segment also comprises a second surface that is oppositely disposed to the first surface, and that generally faces the inner perimeter of the bathtub. In at least one embodiment, at least a portion of the second surface may attach the flexible extended segment to the inner perimeter of the bathtub. As used herein, the inner perimeter of the bathtub includes at least a portion of a front or inner surface of the bathtub and/or at least a portion of a top surface of the bathtub.

As mentioned above, the cover assembly is intended to reduce the risk of physical injury to the individual when located inside of the bathtub. Certain events, which are common inside of bathtubs may result in the individual directly impacting the bathroom. Such events may happen to any individual irrespective of the individual's age and size, and include falling, slipping, bumping, or otherwise coming into direct contact with the bathtub. Accordingly, the protective section may comprise a front structure that may serve as a bumper or shock absorber that will protect an individual from direct physical impact with the bathtub. In at least one embodiment, the cover assembly may comprise a material that is structured to at least partially reduce the risk of physical injury that is associated with events that are common in bathrooms, such as falls. Further, the protective section may comprise front structure having a configuration that at least partially reduces the risk of physical injury during such an event. For example, the protective section may comprise a substantially round configuration.

The protective section and the flexible extended segment may be collectively disposed into and out of an "operative orientation" and an "inoperative orientation". It is within the scope of the present invention that when the front section and the flexible extended segment are disposed in the "operative orientation", that the flexible extended segment, and consequently the cover assembly, be attached to the bathtub. Thus, the "operative orientation" generally comprises the flexible extended segment being attached to the bathtub around the inner perimeter of the bathtub, such that the protective section may protect the individual from direct physical impact with the bathtub. Further, when the protective section and the flexible extended segment are disposed in the "operative orientation", this may reduce spillage of liquid outside of the bathtub. As will be described in more detail below, the "operative orientation" also generally comprises the flexible extended segment being disposed in a "constricted orientation". Conversely, the "inoperative orientation" comprises the flexible extended segment not being attached to the bathtub, and being disposed in an "expanded orientation".

As mentioned above, a feature of the present invention is to provide protection to an individual from direct physical impact with the bathtub. Thus, at least a portion of the cover assembly, may comprise a material that is capable of absorbing energy, such as the energy associated with a direct physical impact. In one embodiment, the protective section comprises a flexible material capable of absorbing the energy associated with a direct physical impact. The flexible extended segment may comprise a similar material as the protective section. Examples of such a flexible material of the protective section, and/or the flexible extended segment, include foam, silicone, rubber, an elastomer, or other suitable material capable of absorbing energy associated with a direct physical impact.

The flexible extended segment should comprise a material that enables it to bend when disposed in the "constricted orientation", such as when the flexible extended segment is attached to the bathtub. The flexible extended segment should comprise a sufficient inherent bias that permits it to return to its natural position. Thus, the material of the flexible extended segment should allow the flexible extended segment to return to its natural position when it is no longer attached to the bathtub, such as when it is disposed in the "expanded orientation". This inherent bias of the flexible extended segment should allow it to exert pressure against bathtub, when attached thereto, and when disposed in the "constricted orientation". The pressure exerted against the bathtub may generally reduce the amount of liquid that may travel between the cover assembly and the bathtub.

As mentioned above, a feature of the cover assembly according to the present invention includes its ability to at least partially reduce spillage of liquid outside of the bathtub. When the protective section and the flexible extended segment are collectively disposed in the "operative orientation", both should collectively define a barrier that may help to maintain liquid inside of the bathtub. Further, when the flexible extended segment is disposed in the "constricted orientation", at least the first surface of the flexible extended segment may assume, or otherwise have a substantially concave configuration. Such a substantially concave configuration of the first surface of the flexible extended segment is advantageous as it is able direct liquid towards an enclosure structure, which may be disposed between the front structure and the first surface of the flexible extended segment. The enclosure structure generally comprises a substantially inclined configuration that is capable of directing a moving body of liquid to the inside of the bathtub.

The cover assembly according to the present invention may comprise an attachment assembly. The attachment assembly comprises at least one attachment structure which may attach at least a portion of the flexible extended segment to the inner perimeter of the bathtub. At least one attachment structure may be disposed on the first surface of the flexible extended segment. In one embodiment, an attachment structure(s) may be disposed on the first surface around an end portion of the flexible extended segment. In another embodiment, an attachment structure(s) may also be disposed on the second surface of the flexible extended segment. The attachment structure(s) may be connected to at least a portion of the bathtub, such as the inner perimeter thereof.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE INVENTION IN ONE OR MORE EMBODIMENTS

Figure 6:
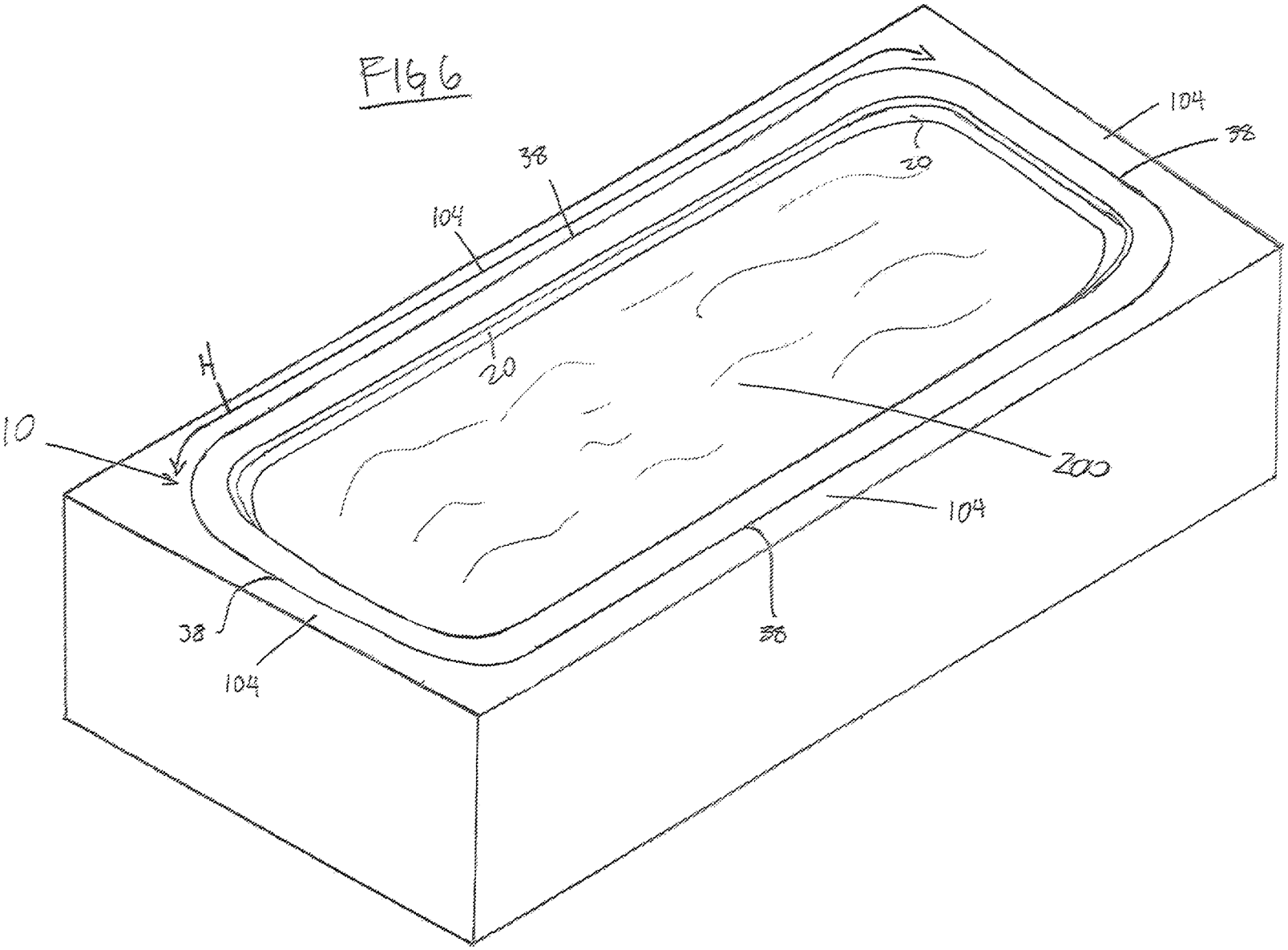
FIG. 6 is a perspective view of a cover assembly in accordance with the present invention, illustrated in an operative orientation.

As shown in FIGS. 1-6, the present invention is directed towards a cover assembly 10 intended for use on or within a bathtub 100. As is perhaps best shown in FIG. 6, the cover assembly 10 may be provided as an elongated component for attachment to the inner perimeter of the bathtub 100, along an inwardly facing wall of the bathtub at an upper end zone thereof, as shown. With specific reference to FIG. 4, as used herein, the "inner perimeter" of the bathtub 100 comprises at least a portion of the front or inner surface 102 of the bathtub 100 and/or at least a portion close to or associated with top surface 104 of the bathtub 100. It is also possible that the perimeter of the bathtub 100 comprise a continuous surface, such as a curved or otherwise rounded surface, but without a clearly defined top wall surface as at 104. The length of the cover assembly 10 may vary according to the size of the bathtub 100, specific dimensional constraints, or personal preference. In one embodiment, the cover assembly 10 may be attached along a portion of the inner perimeter of the bathtub 100. In another embodiment, such as is shown in FIG. 6, the cover assembly 10 is attached substantially along the entirety of the inner perimeter of the bathtub 100. In an alternative embodiment, the cover assembly 10 may be provided as a plurality of elongated components that may be attached to the bathtub 100 in successive, adjacent relation to one another.

The cover assembly 10 of the present invention is intended to avoid or at least partially reduce the spillage of water, soapy water or other liquids from the inside of the bathtub to areas outside the bathtub 100. The cover assembly 10 is also intended to help physically protect an individual located inside of the bathtub 100 from direct physical impact with a portion the bathtub 100, including the top surface 104 of the bathtub 100, and/or the inner surface 102 of the bathtub 100. As used herein, the term "individual" refers to any person that may be located inside of a bathtub 100, including sitting, standing, or otherwise, for the purposes of showering or taking a bath, or for any other purpose that requires the person to be physically located inside of the bathtub 100. As used herein, the "individual" may be a person of different ages and sizes, including, but not limited to, adults, the elderly, infants, toddlers, babies, and teenagers. The "individual" may also include a person with a physical handicap or disability, as well as an otherwise healthy person.

Figure 2:
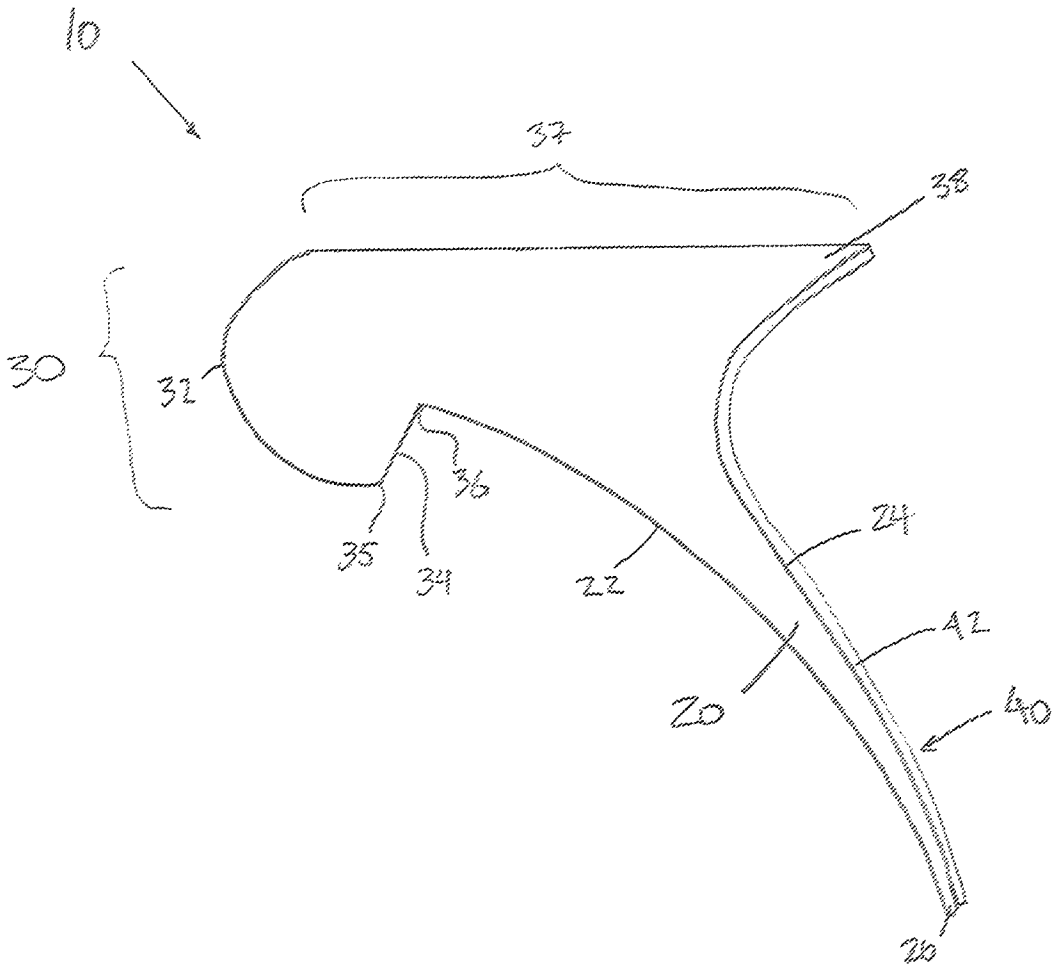
FIG. 2 is also a transverse sectional view of a cover assembly in accordance with the present invention, but illustrating an embodiment that comprises one attachment structure.
Figure 3:
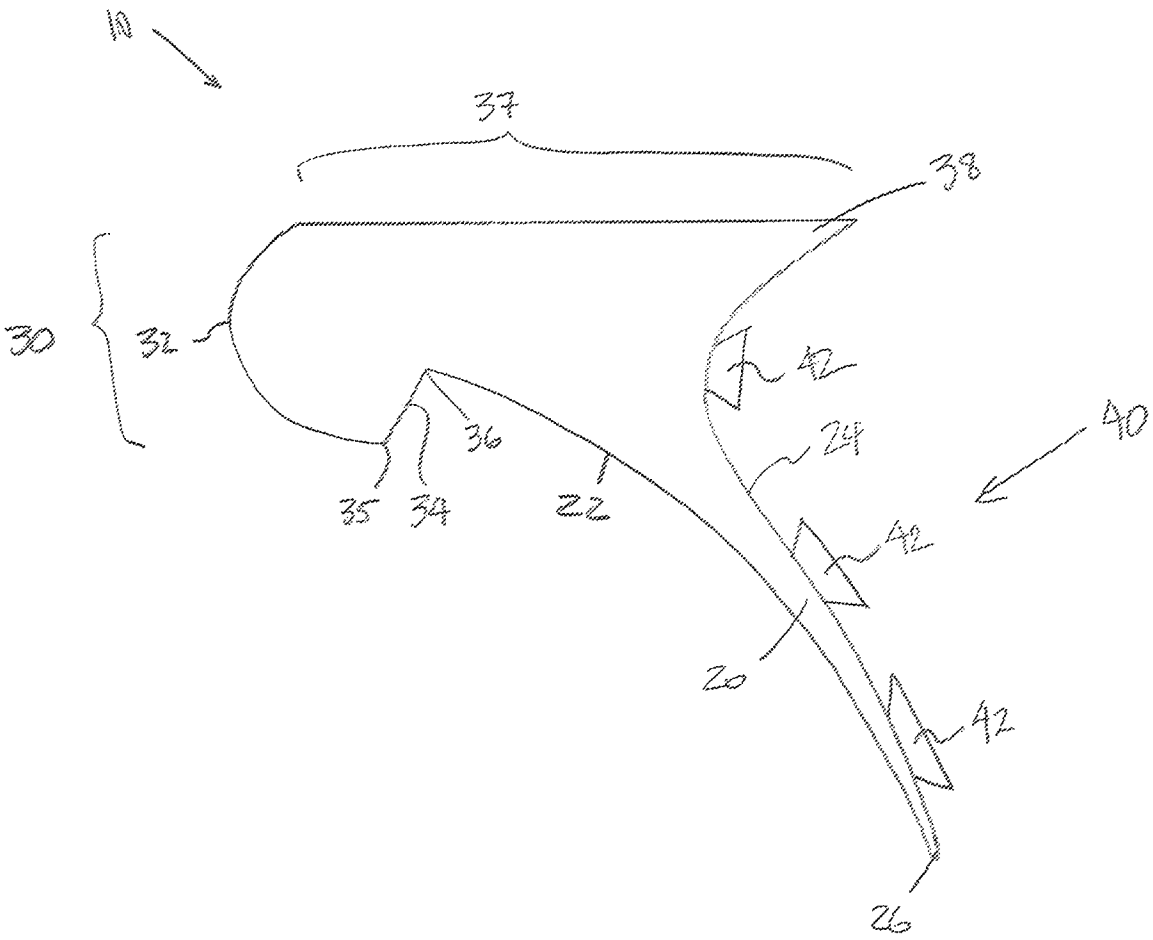
FIG. 3 is also a transverse sectional view of a cover assembly in accordance with the present invention but illustrating an embodiment wherein the attachment structure comprises a plurality of suction cups.
Figure 4:
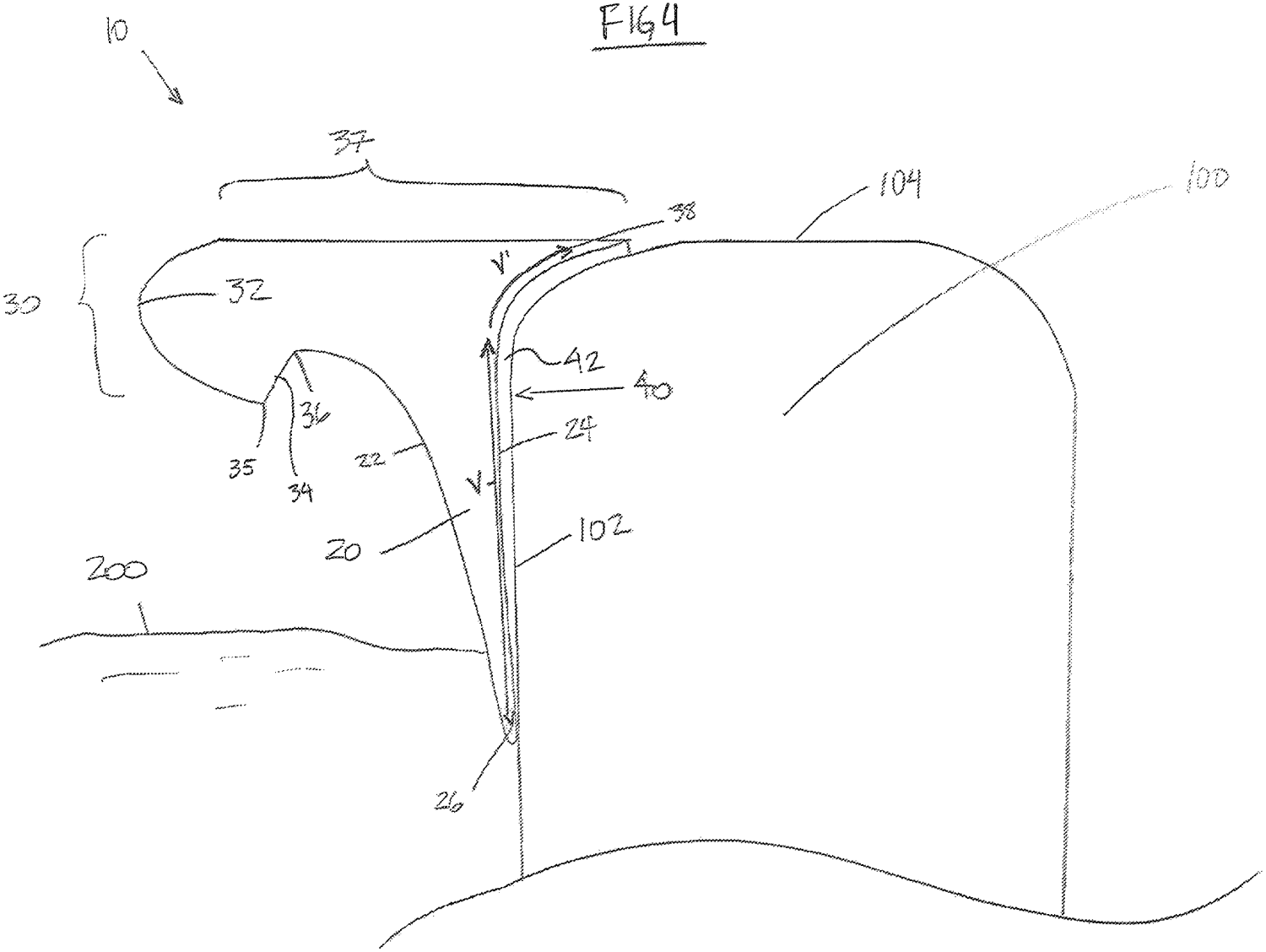
FIG. 4 is a transverse sectional view of a cover assembly in accordance with the present invention and illustrating an embodiment having a protective section and a flexible extended segment and disposed in the operative orientation.
Figure 5:
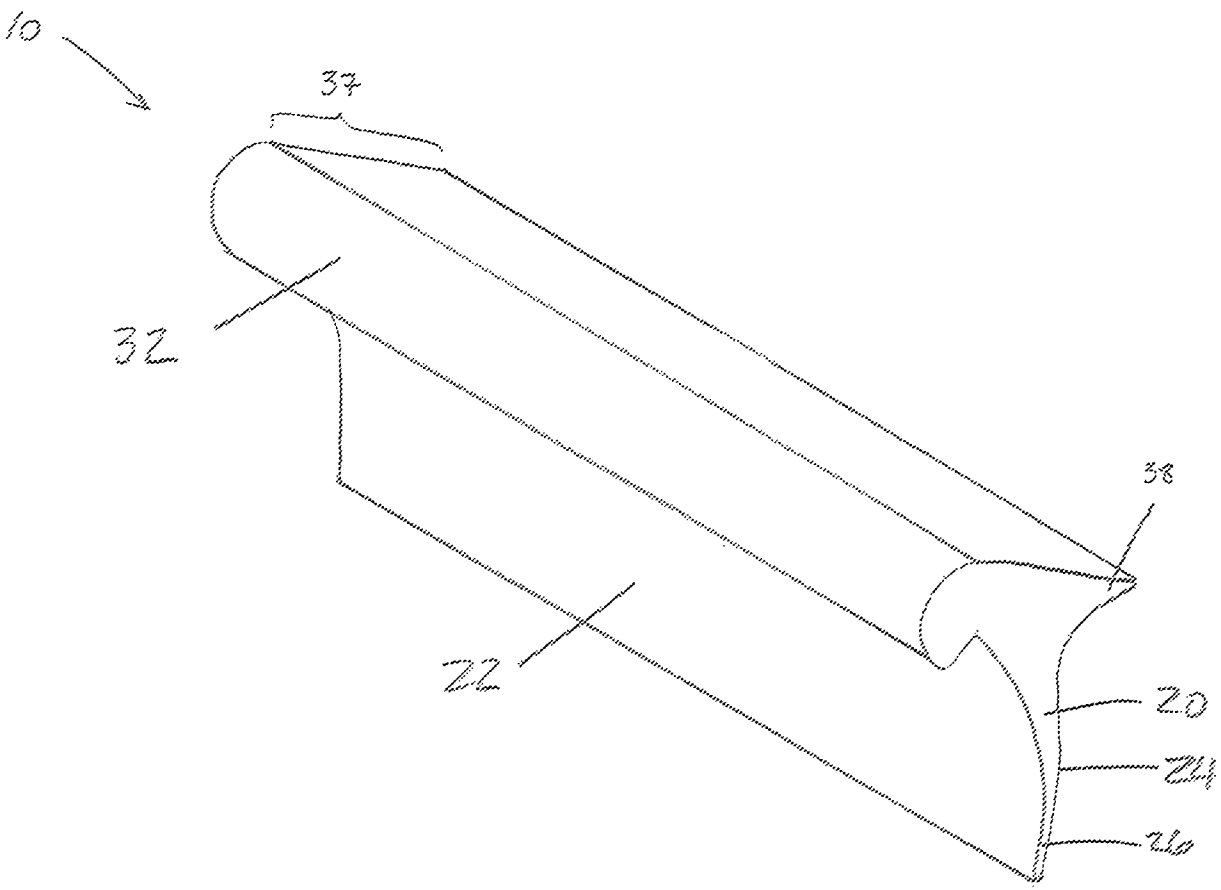
FIG. 5 is a perspective view of a section or part of a cover assembly in accordance with the present invention.

Referring now to FIGS. 1-5, the cover assembly 10 comprises in at least one embodiment both a protective section 30 and a flexible extended segment 20. In one or more embodiments, the protective section 30 and the flexible extended segment 20 are integrally formed so as to define the cover assembly 10 as having a unitary construction. The flexible extended segment 20 is structured and disposed to attach the cover assembly 10 to the bathtub 100. The flexible extended segment 20 may additionally be structured and disposed to provide at least some support for the protective section 30, for reasons described below and, in at least one embodiment, may be disposed generally below and in supporting relation to the protective section 30. As is shown in FIG. 4, the flexible extended segment 20 comprises a first surface 22 that will generally face interior portions of the bathtub 100 as may be filled with water and occupied by a child or other person. As is also shown in FIG. 4, the flexible extended segment 20 also comprises a second surface 24 that will generally face and abut the inner surface 102 of the bathtub 100, along and inner perimeter of the bathtub 100. In the illustrated embodiment of FIG. 4, the first surface 22 and second surface 24 are oppositely disposed to each other and help to define the flexible extended segment 20 and lower body of the cover assembly.

As is perhaps best shown in FIG. 4, the flexible extended segment 20 is preferably attached to the inner perimeter of a bathtub 100 by, at and/or along the second surface 24. For example, in the embodiment illustrated in FIG. 4, the flexible extended segment 20 is attached to the inner perimeter of the bathtub 100 wall 102 along all or substantially the full vertical length of the second surface 24, indicated by arrowed line V, including along an upper portion V' thereof. In other embodiments, however, the attachment of the assembly 10 may be by or along only a portion of second surface 24 to the bathtub wall 102. In at least another embodiment, the flexible extended segment 20 may be attached to the bathtub 100 substantially or entirely along the horizontal length of second surface 24, as indicated by arrowed line H in FIG. 6, corresponding to the inner perimeter of bathtub wall 102. In the illustrative embodiment of FIG. 4, the flexible extended segment 20 is shown as being attached to the inner perimeter of the bathtub 100, which includes a portion of the inner surface 102 of wall of the bathtub 100 and a portion of the top surface 104 of the bathtub 100.

The cover assembly 10 of the present invention is preferably also intended to protect an individual from physical injury when inside of a bathtub 100. Thus, the protective section 30 of the cover assembly 10 is preferably also configured to help protect the individual from a direct physical impact with the bathtub 100 and to help avoid physical injury that might otherwise arise therefrom. As such, it is within the scope of the present invention for at least a portion of the cover assembly 10 to comprise a material that is structured to reduce the risk of physical injury to an individual taking a bath in the bathtub 100, such as from a fall entering or exiting the bathtub 100, standing up, playing in the bathtub 100, etc. Accordingly, the protective section 30 is preferably formed from a material that provides some support and to generally serve as a shock absorber, such as a dense foam material which ideally includes either a waterproof coating or one or more outer layers of waterproof material attached thereto. The material used to form the protective section 30 should be capable of absorbing physical energy, and which may also reduce trauma to the individual after a physical impact. The material used to form the protective section 30 may comprise a flexible material capable of absorbing the energy associated with a direct physical impact and may include foam, rubber, an elastomeric material or other suitable material. As noted above, the cover assembly 10 may comprise a unitary construction wherein both the protective section and the flexible extended segment 20 are integrally formed. As such, the flexible extended segment 20 may comprise a similar material as the protective section 30, but such is not always required.

Additionally, the protective section 30 may include a configuration that at least partially reduces the risk of physical injury to the individual. For example, as is shown at least in FIGS. 1-5, the protective section 30 may also comprise a front structure 32 having a substantially rounded or bulbous configuration and which is sized, structured and disposed to reduce the likelihood of cuts, bruises, and other types of injuries.

Additional structural features of the present invention include the protective section 30 and the flexible extended segment 20 being collectively disposable into at least an "operative orientation", as shown in FIGS. 4 and 6, and in some cases also in an "inoperative orientation," as shown in FIGS. 1, 2, 3 and 5. As is perhaps most clearly shown in the illustrative embodiment of FIG. 4, the "operative orientation" comprises the cover assembly 10 being attached to the bathtub 100 by attachment of the flexible extended segment 20 to the inner surface 102 of the bathtub 100. Accordingly, In the "operative orientation" the cover assembly 10 is attached to the bathtub 100 and further disposed in alignment with or closely adjacent to an upper end of the bathtub wall 102, so as to reduce the likelihood of spillage of liquid outside of the bathtub 100. Thus, and as will be explained in more detail hereinafter, when the protective section 30 and the flexible extended segment 20 are disposed in the "operative orientation", both should collectively define a barrier that will at least partially reduce spillage of liquid outside of the bathtub 100. In the more preferred embodiments, however, the "operative orientation" will include the cover assembly 10 being attached to the bathtub 100 in a way that helps to protect the individual from direct physical impact with the bathtub 100. The collective disposition of the protective section 30 and the flexible extended segment 20 in the "operative orientation" should also provide for an adequate area of protection for the individual.

As an example, in the illustrative embodiment of FIG. 4, the top surface 37 of the protective section 30 is disposed at a substantially perpendicular alignment to a vertical axis. In the illustrative embodiment of FIG. 4, the vertical axis is substantially coincident with the length of the inner surface 102 of the bathtub 100 as shown by directional arrow V. Further, the top surface 37 of the protective section 30 may be disposed substantially coplanar to a top surface of the body of liquid 200 that may be inside of the bathtub 100. Although the foregoing features with respect to the alignment of the cover assembly 10 are advantageous, they are only presented for illustrative purposes, and are not exhaustive of other possible alignments. It is within the scope of the present invention to include different angles of inclination of the cover assembly 10, with respect to the bathtub 100 and/or the body of liquid 200, as may also be effective in reducing spillage of liquid and/or in protecting the individual.

With reference again to FIG. 4, the "operative orientation" further comprises the flexible extended segment 20 being disposed in a "constricted orientation". With reference to FIGS. 1, 2, 3, and 5, when the flexible extended segment 20 and the protective section 30 are collectively disposed in the "inoperative orientation", the flexible extended segment 20, and consequently the cover assembly 10, are not attached to the bathtub 100. Further, when the protective section 30 and the flexible extended segment 20 are collectively disposed in the "inoperative orientation", it is within the scope of the present invention that the flexible extended segment 20 will be disposed in an "expanded orientation".

The flexible extended segment 20 of the cover assembly 10 according to the present invention comprises various properties that enable it to naturally assume the "expanded orientation". The flexible extended segment 20 should comprise a sufficient inherent bias that permits it to return to its natural position. Accordingly, the flexible extended segment 20 may comprise a material and a geometrical configuration that allow the flexible extended segment 20 to bend when it is disposed in the "constricted orientation", such as when it is attached to the bathtub 100. Given the inherent bias of the flexible extended segment, it is within the scope of the present invention that the flexible extended segment 20 have a tendency to return to its original position after it is no longer disposed in the "constricted orientation". Thus, the material and the geometrical configuration of the flexible extended segment 20 should also allow it to return to its natural position in the "expanded orientation", when it is not attached to the bathtub 100. This tendency of the flexible extended segment 20 to return to its natural position, such as when it is disposed in the "constricted orientation", should generally exert pressure against bathtub 100. It is within the scope of the present invention that the flexible extended segment 20 be able to exert sufficient pressure against the bathtub to at least partially reduce the amount of liquid that may travel between the cover assembly 10 and the bathtub 100. As shown in FIG. 4, in order to reduce liquid infiltration, it is advantageous that the flexible extended segment 20 exert pressure against the bathtub 100 around an end portion 26 thereof, as this is an area that is susceptible to infiltration. Thus, in at least one embodiment according of the present invention, the flexible extended segment 20 should exert pressure around the end portion 26, and against the inner surface 102 of the bathtub 100.

Referring now to FIGS. 1-4, in order to help the cover assembly 10 define a barrier that further aids in preventing spills of liquid 200 inside of the bathtub 100 onto outside areas, the protective section 30 may further comprise an enclosure structure 34. In at least one embodiment, the enclosure structure 34 is disposed adjacent to the flexible extended segment 20, and preferably, is disposed between the first surface 22 of the flexible extended segment 20 and the front structure 32 of the protective section 30. Further, when the flexible extended segment 20 is disposed in the "constricted orientation", the first surface 22 of the flexible extended segment 20 may comprise a substantially concave configuration. A substantially concave configuration of the flexible extended segment 20 is advantageous to convey moving liquid towards the enclosure structure 34. Accordingly, and as shown in FIGS. 1-5, the enclosure structure 34 generally comprises a substantially inclined configuration capable of directing a moving body of liquid back to the inside of the bathtub 100. As shown in FIGS. 1-5, a cover assembly 10 may be provided with an enclosure structure 34 comprising a substantially linear configuration. Alternatively, the enclosure structure 34 may comprise a substantially rounded configuration so that it blends with the shape of the front structure 32.

Figure 1:
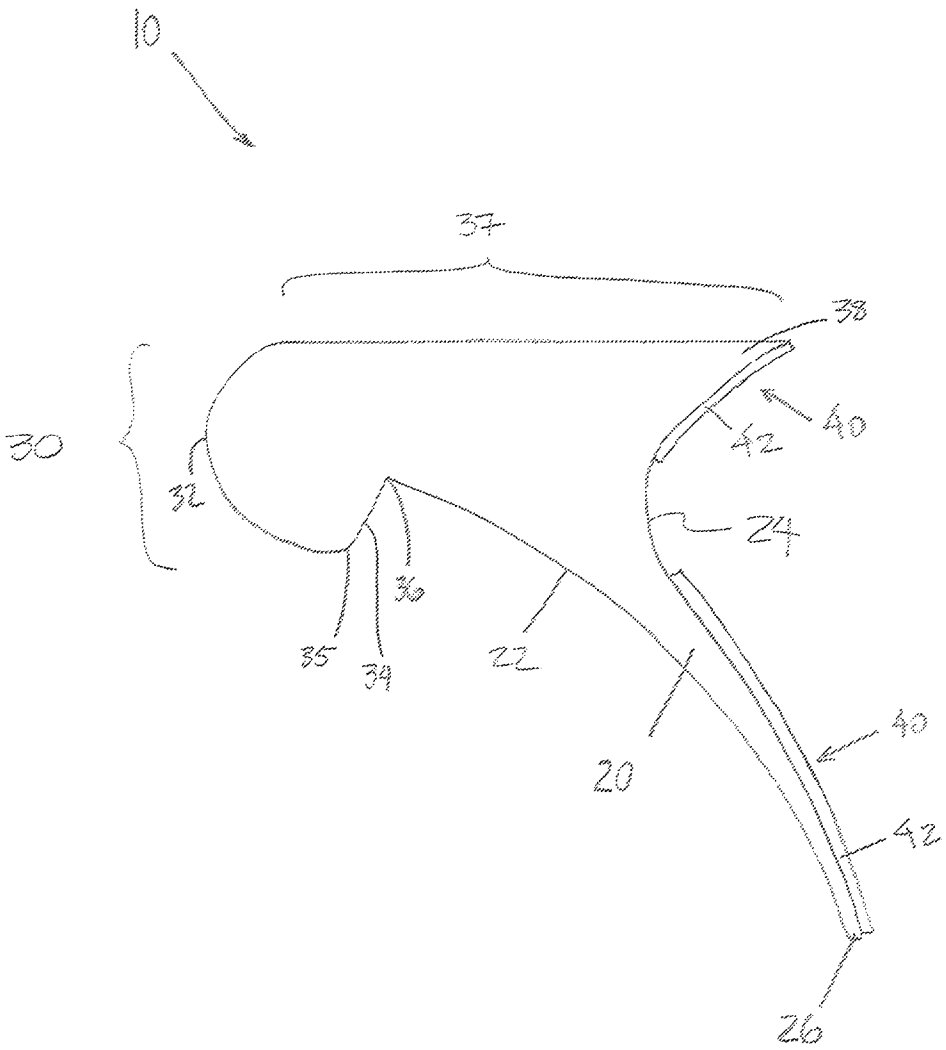
FIG. 1 is a transverse sectional view of a cover assembly in accordance with the present invention, illustrating an embodiment that comprises two attachment structures.

Even further features of the present invention comprise providing a cover assembly 10 with an attachment assembly 40 having at least one attachment structure 42. The attachment structure(s) 42 may attach at least a portion of the flexible extended segment 20 to the inner perimeter of the bathtub 100. For example, in the illustrative embodiment as shown in FIG. 1, an attachment assembly 40 is shown comprising two attachment structures 42, each one disposed on a portion of the second surface of the flexible extended segment 20. In the illustrative embodiment as represented in FIG. 2, an attachment assembly 40 is shown comprising one attachment structure 42 that is disposed substantially around the entirety of the second surface 24 of the flexible extended segment 20. The attachment structure(s) 42 may comprise an adhesive material or composition. The attachment structure(s) 42 may also comprise a different structure that attaches the flexible extended segment to the bathtub 100. Examples of the attachment structure(s) 42 include, but are not necessarily limited to, double sided tape, Velcro®, suction cups, straps, fasteners, or other similar connectors and/or components capable of attaching the cover assembly 10 to the bathtub 100. For example, the illustrative embodiment of FIG. 3, shows three attachment structures 42 disposed on the second surface 24 of the flexible extended segment 20. The illustrative embodiment of FIG. 3 also shows three attachment structures 42 in the form of suction cups. In at least one embodiment, the attachment structure(s) 42 may comprise a waterproof material and/or adhesive. In at least another embodiment, the attachment structure(s) 42 provide sufficient retention to the cover assembly 10 so that it may remain in place, even after an individual directly impacts it.

The attachment structure(s) 42 may be disposed on the first surface 22 of the flexible extended segment 20. In one embodiment, an attachment structure(s) 42 may be disposed on the first surface of the flexible extended segment 20 around the end portion 26. In another embodiment, the attachment structure(s) 42 may be disposed on the second surface 24 of the flexible extended segment 20. In at least one embodiment, an attachment structure(s) 42 may be disposed on the second surface 24, attaching the flexible extended segment 20 to the inner perimeter of the bathtub 100, including the inner surface 102 and/or the top surface 104.

With reference again to FIGS. 1-5, additional features of the present invention comprise a protective section 30 having a rear structure 38 with a shape that corresponds to the shape of the bathtub 100. In at least one embodiment of the present invention, the protective section 30 may comprise a rear structure, indicated as 38. As is perhaps best shown in FIG. 4, the rear structure 38 may comprise a shape that substantially matches the shape of the bathtub 100. As is shown in FIG. 4, the shape of the rear structure 38 may be substantially concave so as to correspond to any rounded edges of the bathtub 100, such as a transition section between the top surface 104 of the bathtub 100 and the inner surface 102 of the bathtub 100. As may be appreciated in FIG. 4, the shape of the rear structure 38 should reduce any gaps or opening that may otherwise exist between the cover assembly 10 and the bathtub 100. In at least one embodiment, the protective section 30 comprises a top surface 37, which may be substantially aligned with the top surface 104 of the bathtub. In at least one embodiment, at least part of the rear structure 38 may be attached to the bathtub by an attachment structure(s) 42.

These and other objects, features and advantages of the present invention will become clearer when the drawings as well as the detailed description are taken into consideration.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A cover assembly attachable to a bathtub, said cover assembly comprising:

a protective section including at least a front structure with a substantially rounded configuration, a flexible extended segment adjacently disposed to said protective section, and including a first surface and a second surface, said protective section and said flexible extended segment collectively disposable into an operative orientation on the bathtub defined by:

(a) said protective section extending away from an inner surface of the bathtub and into an interior portion of the bathtub, (b) said flexible extended segment disposed in a constricted orientation with (i) said first surface of said flexible extended segment at least partially exposed to the interior portion of the bathtub, including any water or other fluid contained therein, (ii) said second surface of said flexible extended segment attached to an inner perimeter of the bathtub, substantially along an upper portion thereof, and (iii) said first surface comprising a substantially concave configuration extending to said protective section and structured to direct moving water or other fluid away from the inner surface of the bathtub and the upper portion thereof.

2. The cover assembly as recited in claim 1 wherein said flexible extended segment is configured to at least partially reduce passage of liquid between said second surface and the inner surface of the bathtub, when in said constricted orientation.

3. The cover assembly as recited in claim 2 wherein said flexible extended segment is disposed in pressure exerting relation to the inner surface of the bathtub, when in said constricted orientation.

4. The cover assembly as recited in claim 1 further comprising an attachment assembly comprising at least one attachment structure configured to attach at least a portion of said flexible extended segment to at least a portion of the inner surface of the bathtub.

5. The cover assembly as recited in claim 4 wherein said at least one attachment structure is configured to attach at least a portion of said second surface of said flexible extended segment to at least a portion of the inner surface of the bathtub.

6. The cover assembly as recited in claim 5 wherein said at least one attachment structure is configured to attach a majority of said second surface of said flexible extended segment to at least a portion of the inner surface of the bathtub.

7. The cover assembly as recited in claim 1 wherein said operative orientation comprises said flexible extended segment and said protective section collectively defining a barrier; said barrier configured to at least partially reduce spillage outside of the bathtub.

8. The cover assembly as recited in claim 7 wherein said protective section comprises an enclosure structure disposed between said flexible extended segment and said protective section.

9. The cover assembly as recited in claim 8 wherein said enclosure structure comprises a proximal end and a distal end; said proximal end disposed substantially coincident with said front structure; said distal end disposed substantially coincident with said first surface.

10. The cover assembly as recited in claim 9 wherein said proximal end of said enclosure structure is disposed lower than said distal end of said enclosure structure.

11. The cover assembly as recited in claim 1 wherein said flexible extended segment comprises an elastic material.

12. A cover assembly attachable to a bathtub and structured to provide protection to an individual inside of the bathtub, said cover assembly comprising:

a protective section comprising a front structure and a top surface, a flexible extended segment adjacently disposed to said protective section, and including a first surface and a second surface, an attachment assembly disposed at least on said second surface and comprising at least one attachment structure configured to attach at least a portion of said flexible extended segment to at least a portion of the inner perimeter of the bathtub, at least said flexible extended segment disposable into a constricted orientation and having an inherent bias to return to an expanded orientation;

said protective section and said flexible extended segment collectively disposable into an operative orientation wherein:

(a) said flexible extended segment is disposed in said constricted orientation, (b) said second surface is attached to at least a portion of an inner perimeter of the bathtub via said attachment assembly, (c) said protective section comprising a rear structure is configured to substantially correspond to the shape of the inner perimeter of the bathtub; and (d) said inherent bias disposes said flexible extended segment in sufficient force exerting relation to the inner perimeter of the bathtub to impede liquid infiltration at an end portion of said flexible extended segment.

13. The cover assembly as recited in claim 12 wherein said front structure of said protective section is structured to protect the individual from direct physical impact with the bathtub, when said protective section and said flexible extended segment are collectively disposed in said operative orientation.

14. The cover assembly as recited in claim 12 wherein said front structure of said protective section comprises a substantially round configuration.

15. The cover as recited in claim 12 wherein said operative orientation further comprises said top surface of said protective section being substantially coplanar with a top surface of the bathtub.

16. The cover assembly of claim 12, wherein said protective section and said flexible extended segment abut only the inner perimeter of the bathtub.

17. The cover assembly of claim 12, wherein said flexible extended segment is comprised of a material selected from the group consisting of foam, silicone, rubber, an elastomer, and combinations thereof.

18. A cover assembly attachable to a bathtub, said cover assembly comprising:

a protective section including at least a front structure with a substantially rounded configuration, a flexible extended segment adjacently disposed to said protective section, and including a first surface and a second surface, an attachment assembly disposed at least on said second surface and comprising at least one attachment structure configured to attach at least a portion of said flexible extended segment to at least a portion of an inner perimeter of the bathtub, at least said flexible extended segment disposable into a constricted orientation and having an inherent bias to return to an expanded orientation, said protective section and said flexible extended segment collectively disposable into an operative orientation on the bathtub defined by:

(a) said protective section structured and disposed to be substantially coplanar with a top surface of the bathtub and extending away from an inner surface of the bathtub and towards an interior portion of the bathtub; and (b) said flexible extended segment disposed in said constricted orientation with:

(i) said first surface of said flexible extended segment at least partially exposed to an interior portion of the bathtub, including any water or other fluid contained therein;

(ii) said second surface of said flexible extended segment attached to the inner perimeter of the bathtub, via said attachment assembly, substantially along an upper portion thereof;

(iii) said protective section comprising a rear structure configured to substantially correspond to the shape of the inner perimeter of the bathtub;

(iv) said first surface comprising a substantially concave configuration extending to said protective section and structured to convey moving water or other fluid away from the inner surface of the bathtub and an upper portion thereof;

(v) said inherent bias disposing said flexible extended segment in sufficient force exerting relation to the inner perimeter of the bathtub to impede liquid infiltration at an end portion of said flexible extended segment; and (vi) said flexible extended segment comprised of a material selected from the group consisting of foam, silicone, rubber, an elastomer, and combinations thereof.

19. The cover assembly as recited in claim 18, further comprising an enclosure structure disposed adjacent to said flexible extended segment, said enclosure structure having a substantially inclined configuration further capable of directing a moving body of liquid away from the inner surface of the bathtub and upper portion thereof, and towards the interior portion of the bathtub.

20. The cover assembly of claim 18, wherein said protective section and said flexible extended segment only abut the inner perimeter of the bathtub.

* * * * *